US009114324B2

(12) United States Patent
Chuang et al.

(10) Patent No.: US 9,114,324 B2
(45) Date of Patent: Aug. 25, 2015

(54) TOY VEHICLE MONORAIL TRACK SET

(71) Applicant: Mattel, Inc., El Segundo, CA (US)

(72) Inventors: Peter Chuang, El Segundo, CA (US); Steven Verbera, El Segundo, CA (US)

(73) Assignee: Mattel, Inc., El Segundo, CA (US)

( * ) Notice: Subject to any disclaimer, the term of this patent is extended or adjusted under 35 U.S.C. 154(b) by 199 days.

(21) Appl. No.: 13/861,957

(22) Filed: Apr. 12, 2013

(65) Prior Publication Data

US 2013/0273806 A1 Oct. 17, 2013

Related U.S. Application Data

(60) Provisional application No. 61/623,242, filed on Apr. 12, 2012.

(51) Int. Cl.

| | |
|---|---|
| ***A63H 18/00*** | (2006.01) |
| ***A63H 19/24*** | (2006.01) |
| ***A63H 21/04*** | (2006.01) |
| ***A63H 27/04*** | (2006.01) |

(52) U.S. Cl.

CPC ..... *A63H 19/24* (2013.01); *A63H 21/04* (2013.01); *A63H 27/04* (2013.01)

(58) Field of Classification Search

USPC ..... 446/227, 228, 229, 431, 433, 434, 439, 446/444, 446

See application file for complete search history.

(56) References Cited

U.S. PATENT DOCUMENTS

| | | | | |
|---|---|---|---|---|
| 763,036 A | | 6/1904 | Austin et al. | |
| 1,023,324 A | | 4/1912 | Michener | |
| 1,355,911 A | | 10/1920 | Riddick | |
| 1,618,925 A | | 2/1927 | Harris | |
| 1,706,065 A | | 3/1929 | Jenkins | |
| 1,709,512 A | | 4/1929 | Alderdice | |
| 1,756,608 A | | 4/1930 | Reider | |
| 1,767,496 A | * | 6/1930 | Wilson | 104/23.1 |
| 1,778,699 A | * | 10/1930 | Welch | 446/228 |
| 2,083,218 A | | 6/1937 | Carter | |
| 2,101,276 A | | 12/1937 | Walter | |
| 2,285,988 A | | 6/1942 | Kroll | |
| 2,388,513 A | | 11/1945 | Zwickel | |

(Continued)

FOREIGN PATENT DOCUMENTS

| | | | |
|---|---|---|---|
| KR | 10-2005-0102962 | A | 10/2005 |
| WO | 2005102487 | A1 | 11/2005 |

OTHER PUBLICATIONS

Int'l Search Report and Written Opinion issued May 15, 2013 in Int'l Application No. PCT/US2012/038371.

(Continued)

*Primary Examiner* — Kurt Fernstrom

(74) *Attorney, Agent, or Firm* — Panitch Schwarze Belisario & Nadel LLP

(57) ABSTRACT

A carrier and a conventional toy vehicle have mating structures to releasably connect the two together. The carrier is configured to support the vehicle to run along a T shaped portion of the monorail track. The carrier has a main housing having the mating structure and a through channel on upper and lower sides. Rollers support the carrier to move on the upper running surface of the track while other structures extend beneath the running surface to capture the surface in the through channel. Weights are supported from the main housing in legs extending below the main housing, through channel and running surface.

20 Claims, 7 Drawing Sheets

(56) References Cited

U.S. PATENT DOCUMENTS

| | | | | | |
|---|---|---|---|---|---|
| 2,465,788 | A | | 3/1949 | Brown | |
| 2,543,375 | A | * | 2/1951 | Phillips | 446/228 |
| 2,595,061 | A | | 4/1952 | Downey | |
| 2,646,645 | A | | 7/1953 | Cuervo | |
| D170,748 | S | * | 11/1953 | Cohen | D21/540 |
| 2,789,391 | A | * | 4/1957 | Perry | 446/227 |
| 2,899,910 | A | | 8/1959 | Vivari | |
| 3,041,983 | A | * | 7/1962 | Liversidge et al. | 104/93 |
| 3,209,491 | A | | 10/1965 | Roeper | |
| 3,331,153 | A | * | 7/1967 | Woods | 446/229 |
| 3,376,844 | A | | 4/1968 | Wood | |
| 3,604,148 | A | | 9/1971 | Neuhierl | |
| 3,611,622 | A | * | 10/1971 | Lemelson | 446/179 |
| 3,611,632 | A | | 10/1971 | Smith | |
| 3,613,306 | A | | 10/1971 | Arai | |
| 3,648,407 | A | * | 3/1972 | Pressman | 104/120 |
| 3,693,290 | A | | 9/1972 | Breslow et al. | |
| 3,986,717 | A | | 10/1976 | Kirby et al. | |
| 4,034,678 | A | | 7/1977 | Wilson | |
| 4,537,577 | A | | 8/1985 | Sansome et al. | |
| RE32,106 | E | * | 4/1986 | Lemelson | 446/138 |
| 4,605,229 | A | * | 8/1986 | McKay | 463/59 |
| 4,715,602 | A | | 12/1987 | May et al. | |
| 4,861,306 | A | | 8/1989 | Bolli et al. | |
| 4,872,680 | A | | 10/1989 | Dennis | |
| 5,080,628 | A | | 1/1992 | Tate | |
| 5,118,320 | A | | 6/1992 | Miller | |
| 5,626,504 | A | * | 5/1997 | Liu | 446/229 |
| 5,868,599 | A | * | 2/1999 | Kaufman | 446/148 |
| 5,980,358 | A | | 11/1999 | Diller | |
| 6,520,830 | B1 | * | 2/2003 | Vollmar et al. | 446/444 |
| 7,241,223 | B1 | | 7/2007 | Caudill | |
| 7,285,035 | B1 | | 10/2007 | Tullis | |
| 7,651,398 | B2 | | 1/2010 | Ostendorff et al. | |
| 7,857,679 | B2 | | 12/2010 | O'Connor et al. | |
| 2005/0287919 | A1 | * | 12/2005 | Sheltman et al. | 446/444 |
| 2007/0259600 | A1 | * | 11/2007 | Bedford et al. | 446/444 |
| 2008/0014832 | A1 | | 1/2008 | Ostendorff et al. | |
| 2008/0268743 | A1 | | 10/2008 | O'Connor et al. | |
| 2010/0159800 | A1 | | 6/2010 | O'Connor | |
| 2010/0273394 | A1 | | 10/2010 | O'Connor et al. | |
| 2010/0279583 | A1 | | 11/2010 | Laurienzo et al. | |
| 2010/0291833 | A1 | | 11/2010 | O'Connor et al. | |
| 2011/0092132 | A1 | | 4/2011 | O'Connor et al. | |
| 2011/0124265 | A1 | | 5/2011 | O'Connor et al. | |
| 2011/0269369 | A1 | | 11/2011 | O'Connor et al. | |

OTHER PUBLICATIONS

1999 Catalog #24466 of Mattel, Inc., El Segundo, California 90246, front cover (both sides) p. 101, Super Jet Stunt Set, (3 pages).

* cited by examiner

TOY VEHICLE MONORAIL TRACK SET

CROSS REFERENCE TO RELATED APPLICATION

This application is related to provisional U.S. Application No. 61/623,242 filed Apr. 12, 2012 and incorporated by reference herein in its entirety.

BACKGROUND OF THE INVENTION

Play sets for toy vehicles are popular toys which are known to provide entertainment and excitement to a user. These play sets typically include a track configuration intended to guide a propelled toy vehicle, such as a small scale die-cast metal toy vehicle, through a course. The track configurations include closed-loop continuous track arrangements and open-end arrangements. Toy vehicles are placed on these play set tracks and propelled across the configuration by hand or by an external propulsion means or gravity.

To bring increased entertainment and excitement to play sets, track configurations may include features such as loop segments and other types of track configurations known in the art. Loop segments have been of the centrifugal type where a free running toy vehicle is directed through a vertically oriented loop by building up sufficient speed approaching the loop in order to maintain the vehicle in contact with the track through the inversion portion of the loop.

Additionally, attempts have been made at incorporating jumps into these race sets by which a traveling toy vehicle is briefly separated from the track to ultimately rejoin the track at a downstream location. However, these attempts have been limited due to the complexities of ensuring that the launched toy vehicle lands on the downstream track segment in a proper orientation to thus allow the vehicle to continue its course of travel.

Accordingly, a play set for toy vehicles is desired which can provide the entertainment and excitement by generating different types of loops from those normally used and which additionally include provisions for launching and a toy vehicle onto a track in a proper orientation to allow continuous play.

BRIEF SUMMARY OF THE INVENTION

A carrier configured for removable attachment to a toy vehicle to connect the toy vehicle with and to support the toy vehicle to move along a running surface of an elongated monorail track. The carrier comprises a main housing having a lower side with a through channel configured to receive at least the running surface portion of the monorail track; at least one toy connector structure on an upper side of the main housing opposite the lower side, the connector structure being configured for removable attachment of the carrier to the toy vehicle; and at least a first weight member supported from the main housing below the main housing and the through channel and the running surface of the monorail track in the through channel.

A toy vehicle race set comprising: an elongated monorail track; a toy vehicle; a carrier removably attached to the toy vehicle and configured to secure the toy vehicle to the monorail track so as to support the toy vehicle to run along the monorail track, the carrier being the only connection between the toy vehicle and the monorail track, the carrier having a through channel configured to capture at least a portion of the track.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

DETAILED DESCRIPTION OF THE INVENTION

Figure 1:
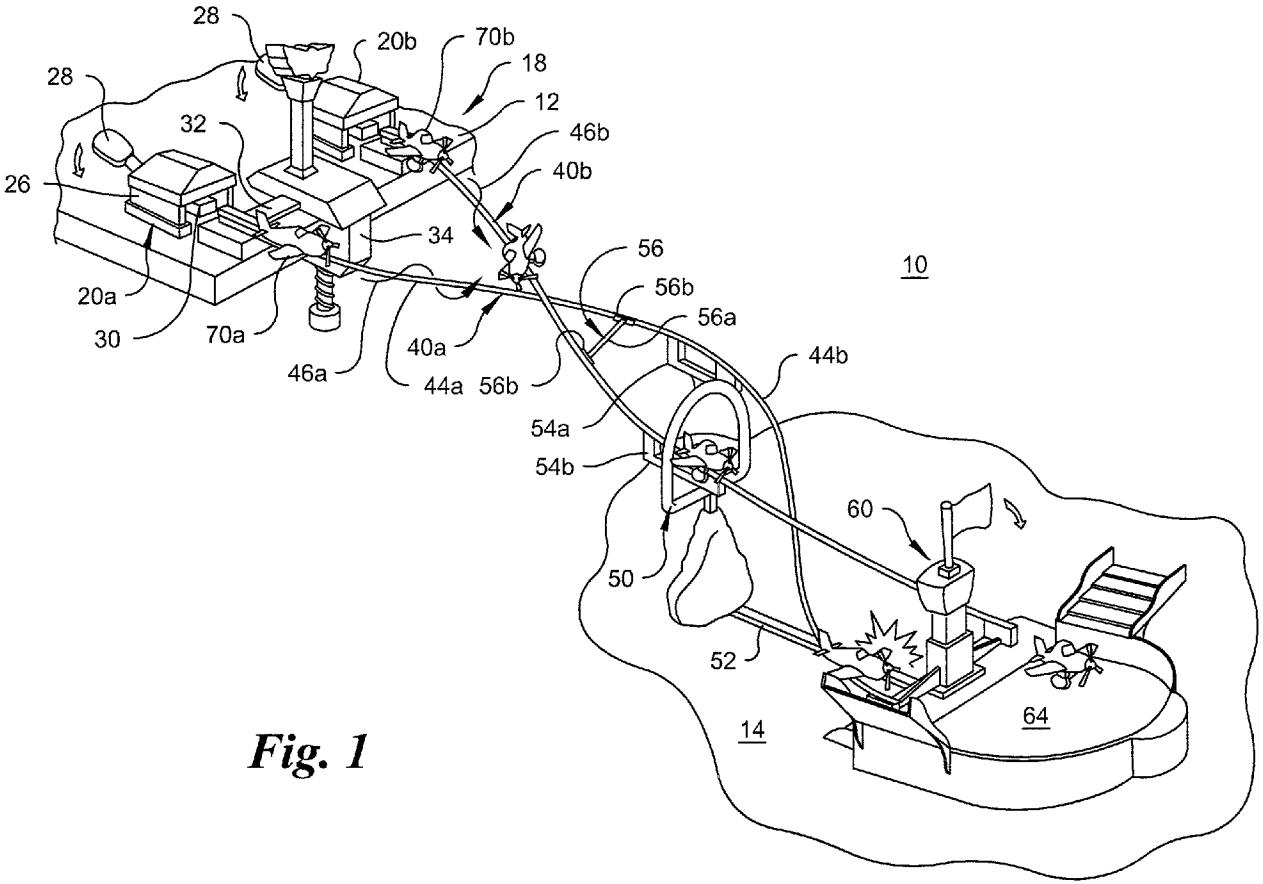
FIG. 1 is a diagrammatic perspective of a toy vehicle monorail track set of the present invention.

Certain terminology is used in the following description for convenience only and is not limiting. The words "right," "left," "lower" and "upper" designate directions in the drawings to which reference is made and, in certain cases, to the structures themselves depicted in the drawings. The words "inwardly" and "outwardly" refer to directions toward and away from, respectively, the geometric center of the stated component and designated parts thereof. The terminology includes the words above specifically mentioned, derivatives thereof and words of similar import.

FIG. 1 depicts a first embodiment toy vehicle monorail track play set identified generally at 10. The play set 10 includes a starting gate 18 with at least one and preferably first and second mirror image launchers 20*a*, 20*b* mounted by means of a bracket 32 and clamp 34 to an upper support surface 12. First and second elongated monorail tracks 40*a*, 40*b* extend respectively from a beginning end at each launcher 20*a*, 20*b* to and through an intermediate support 50 to a terminal end at a finish gate 60. A catchment 64 with raised walls is located downstream from the finish gate 60 to receive and retain the toy vehicles 70*a*, 70*b* as they exit terminal ends of the monorail tracks 40 at or near the finish gate 60.

Play set 10 is gravity powered. The starting gate 18 and launchers 20 are located on an upper or raised support surface 12 while the intermediate support 50, finish gate 60 and catchment 64 are all located below the upper support surface 12, in this case on one lower support surface 14 as shown but several separate lower support surfaces of different heights may be used. Toy vehicles 70 released from the starting gate 18 on the upper ends of the monorail tracks 40 will, from their own weight, accelerate down the monorail tracks 40 to the finish gate 60. Toy vehicles 70 could be manually released but launchers 20 as described are preferably provided to allow a user to quickly accelerate a toy vehicle 70 and drive it at higher speed along the respective monorail track. The provision of first and second launchers 20*a*, 20*b* with first and second monorail tracks 40*a*, 40*b* and a common finish gate 60 permit two toy vehicles 70*a*, 70*b* to be raced with a degree of user input to initially accelerate each toy vehicle 70. However, it will be appreciated that a track set of the present invention may include only a single monorail track on which one of more toy vehicles may be run, with or without starting and/or finishing gate accessories. The monorail tracks 40*a*, 40*b* extend continuously between the launchers 20*a*, 20*b* and starting gate 18 and the finish gate 60 but it will be appreciated that each continuous track may be formed of separate, sequentially connected sections as will be demonstrated.

Figure 6:
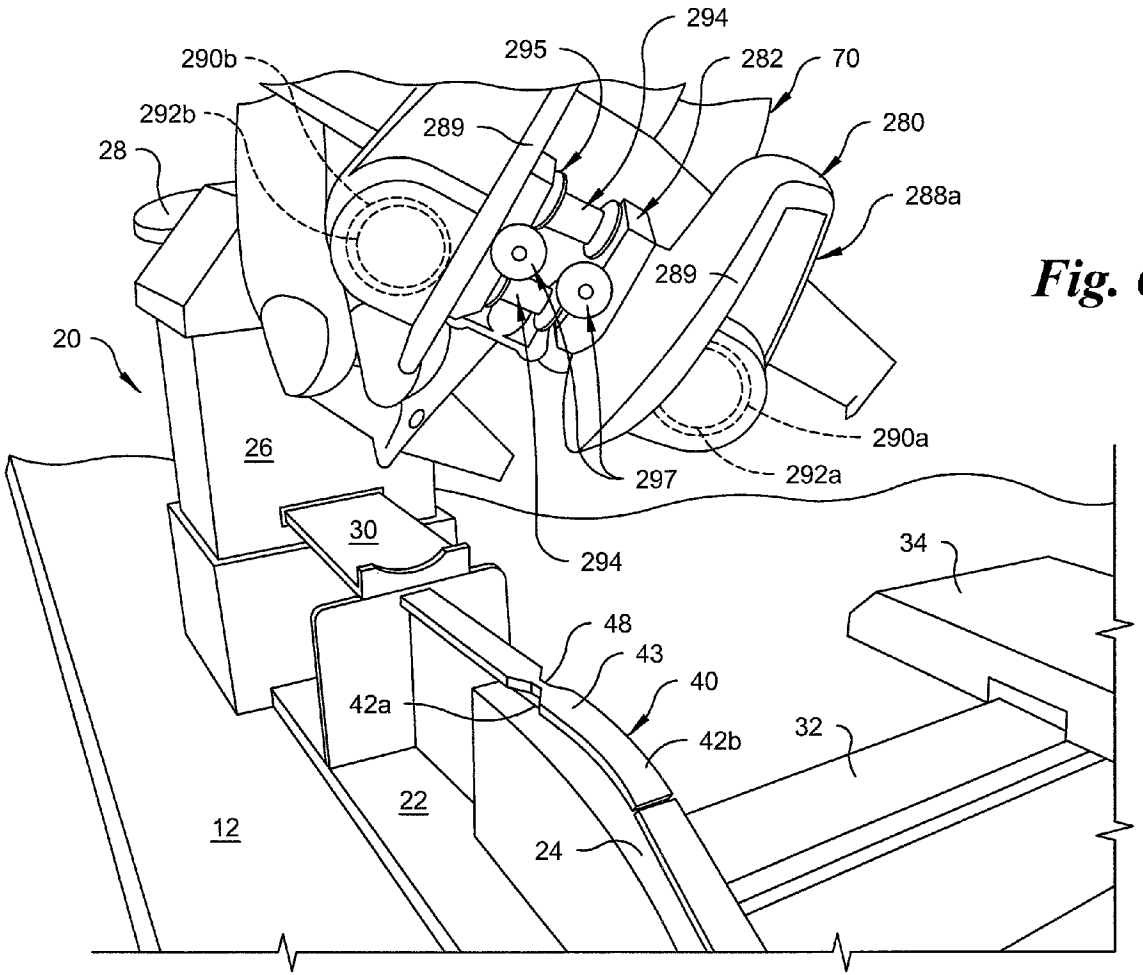
FIG. 6 is a perspective view of the toy plane with carrier of FIG. 5 showing provision in the monorail track for releasable attachment of the carrier to the monorail track.

Referring to FIG. 6, one launcher 20 can be seen without a toy vehicle 70 mounted to the monorail track 40. Each launcher 20 includes a base 22, supporting a rail bracket 24 and a housing 26 behind the rail bracket 24. The housing 26 supports a plunger 30 extending from the front of the housing 26 and operably connected by a conventional mechanical linkage such as a bell crank arrangement (in the housing and not depicted) with a manual actuator 28 such as a lever extended from the rear of the housing 26. The plunger 30 is advanced farther out of the housing 26 than its position in FIG. 6 by movement of the actuator 28 to propel the toy vehicle 70 from the horizontal upper end of the track 40. Bracket 32 may itself just be a rectangular beam that is received in a recess in the side of the launcher base 22 or launcher bracket 24 or both on a lateral side of the launcher 20.

Figure 4:
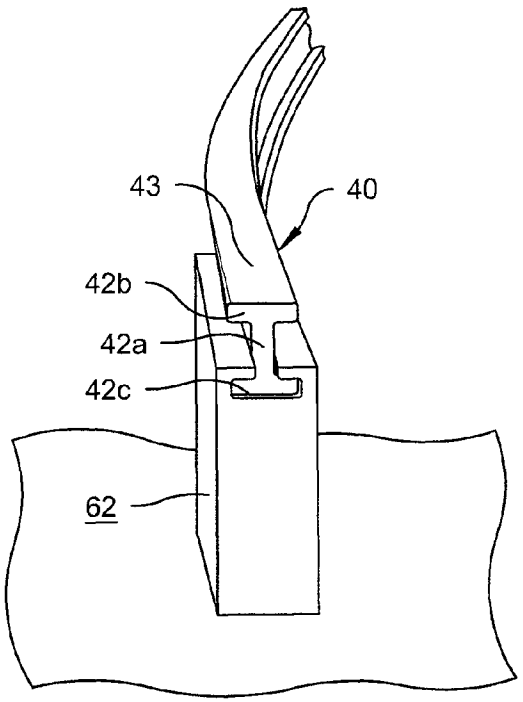
FIG. 4 is a perspective view of an end portion of the monorail track.
Figure 3:
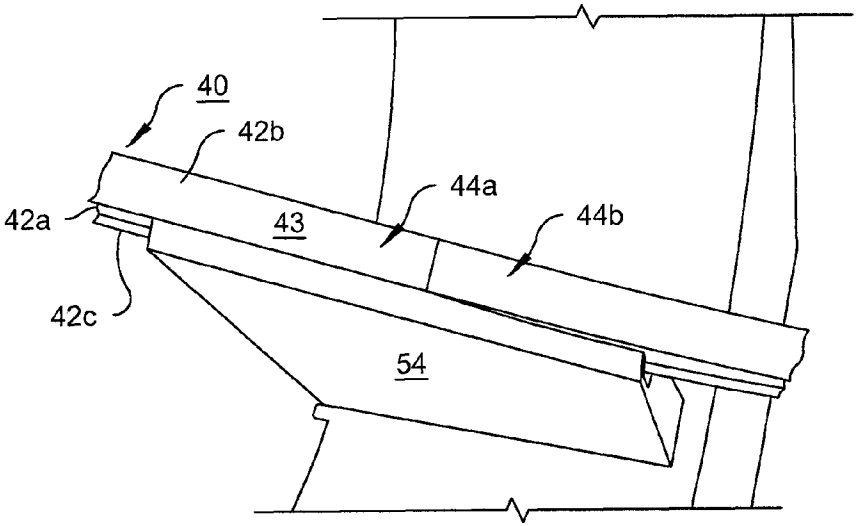
FIG. 3 is a perspective view of an intermediate portion of the monorail track in a support bracket.

One of the monorail tracks 40 is seen in FIG. 3 at an intermediate support bracket 54 and in FIG. 4 at a bracket 62 of the finish gate 60. As can be seen in those figures and FIG. 5, each monorail track 40 preferable has a transverse cross-sectional "I" shape with a larger main or central beam 42*a* and two smaller transverse beams 42*b* and 42*c* perpendicular to the central beam 42*a* at the longitudinal ends of the central beam 42*a*. As also can be seen in these figures, an outer surface 43 of one transverse beam 42*b* is exposed to form a running surface of the track 40 and to capture and retain a toy vehicle 70 to run along the track 40 as will be explained while the other transverse beam 42*c* provides a structure to capture the track 40 in various parts of the set provided to support or interact with the track 40. While an I shaped configuration is preferred for simplicity, it will be appreciated that the monorail tracks 40 could be provided with a wide variety of shapes which would permit capture of the toy vehicle by the track along one side and capture of the track along the opposing side. It will further be appreciated that the central beam 42*a* and the first transverse beam 42*b* form a "T" shaped carrier support portion of the track 40.

The monorail tracks 40 are preferably polymer plastic extrusions of uniform cross-sectional shape ("I") and dimensions along their lengths. The tracks could be formed by coextrusions of different colors, for example, each color being one of the transverse beams 42*b*, 42*c* and an adjoining half of the main beam 42*a*. This would make it easier for a child to see which transverse beam will be carrying the toy vehicle and which should be secured to the various support structures. Also, as shown in FIG. 3, the tracks 40 might be formed of individual track sections 44*a*, 44*b* sequentially arranged between different supports, for example sections between launchers 20 and support 50 and support 50 and finish gate 60, and connected together at the supports like 50 in FIG. 1 to permit variation in the length, layout and characteristics of the individual sections forming the tracks 40. For example, track sections may be made of different materials in different configurations. Some sections 44*b* may be sufficiently flexible that they can be curved to some extent when laid out by the user. Some sections like section 44*a* may be manufactured and supplied having predetermined twist or even a spiral or a helical portion of plural complete revolutions along at least part of their lengths, as indicated by helical arrows 46*a*, 46*b* in FIG. 1, to cause angular movement or barrel rolling by the toy vehicle following the track, thereby varying the difficulty of and increasing the entertainment generated by the track. Also, sections of track can be manufactured of a flexible polymer in lengths that permit them to be curved or even twist in one or more complete revolutions as desired by the user in assembling the track.

Referring to the various figures, one form of a toy vehicle 70 is preferably a conventional plane with a fuselage 72, supporting a pair of wings 74, with a pair of landing gear wheels 76 to support the plane for conventional play apart from the play set 10. A plane is just one form of toy vehicle that might be enjoyably used with the monorail tracks of the present invention. Other toy vehicles could be other forms of aircraft (e.g. helicopters, space ships, missiles, dirigibles) as well as more unusual vehicles such as cable cars, roller coaster cars, mine cars and even parachutes, broom sticks, swings, etc. for which a story connection might be made between the vehicle and the track set.

Figure 2:
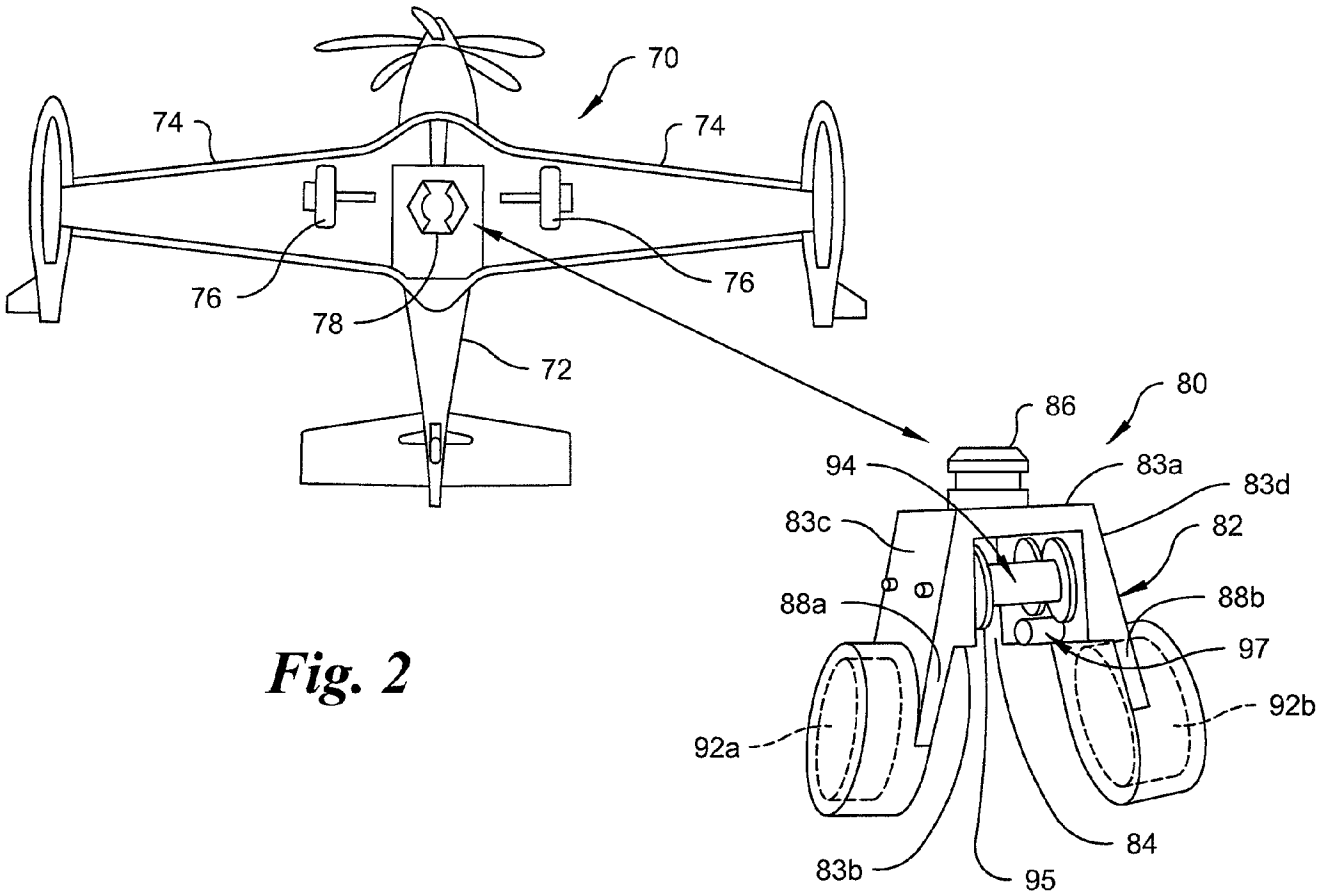
FIG. 2 is a bottom plan view of a toy vehicle in the form of a toy plane and a monorail carrier configured for removable attachment to the plane.

Referring to FIG. 2, a carrier 80 is configured for removable attachment to the bottom of the toy vehicle 70 to connect the vehicle 70 with and support the toy vehicle 70 to run along the running or outer surface 43 of the monorail track 40. Carrier 80 is the only connection between the toy vehicle 70 and the monorail track 40. Toy vehicle 70 has a carrier connector structure 78 preferably in the form of a generally hexagonal recess in its bottom of its fuselage 72 between the landing gear wheels 76. The carrier connector structure 78 is configured to releasably mate with a vehicle connector structure 86, for example, a mushroom-headed stalk on and extending away from an upper surface or side 83*a* of a main housing 82 of the carrier 80. Opposite the vehicle connector structure 86, the carrier 80 has a through channel 84 configured to receive at least a portion 42*b* of the monorail track 40 forming the running surface 43. The through channel 84 preferably has a generally inverted U-shape configuration, formed by and located on a lower side 83*b* of the housing 82 opposite the upper side 83*a* and vehicle connector structure 86. Carrier 80 further includes a pair of spaced apart, preferably mirror image legs 88*a*, 88*b*, extending downwardly and away from lateral sides 83*c*, 83*d* and the bottom side 83*b* of the main housing 82 and the through channel 84, on opposite sides of the through channel 84. The legs 88*a*, 88*b* contain first and second weight members 92*a*, 92*b* (in phantom), respectively, which the legs support from the main housing 82 below the main housing 82 and the through channel 84 and the running surface 43 of the monorail track 40 received in the through channel 84. The weight members 92*a*, 92*b* assure there is enough gravitational force acting on the combination vehicle 70/carrier 80 to accelerate the combination 70/80 down the track 40 overcoming any friction.

To further assure smooth movement of the combination 70/80 down a track 40, the carrier 80 is provided with at least one and, as seen in FIG. 2, preferably two rollers 94. Rollers 94 are suggestedly spools, each having a pair of axially spaced, radially extending outer flanges 95. To capture at least a portion of the monorail track 40, the carrier 80 is further configured by the provision of at least one and preferably a pair of opposing fingers, one of which is seen at 97 in FIG. 2, extending towards one another from inner, facing sides of the main housing 82 forming sides of the through channel 84. The fingers 97 are located sufficiently beneath the roller(s) 94 to receive the transverse beam 42*b* therebetween and are sufficiently spaced apart at their adjoining tips to receive the central beam 42*a* there between and thereby trap the transverse beam 42*b* portion of the monorail track 40 with the running surface 43.

Figure 5:
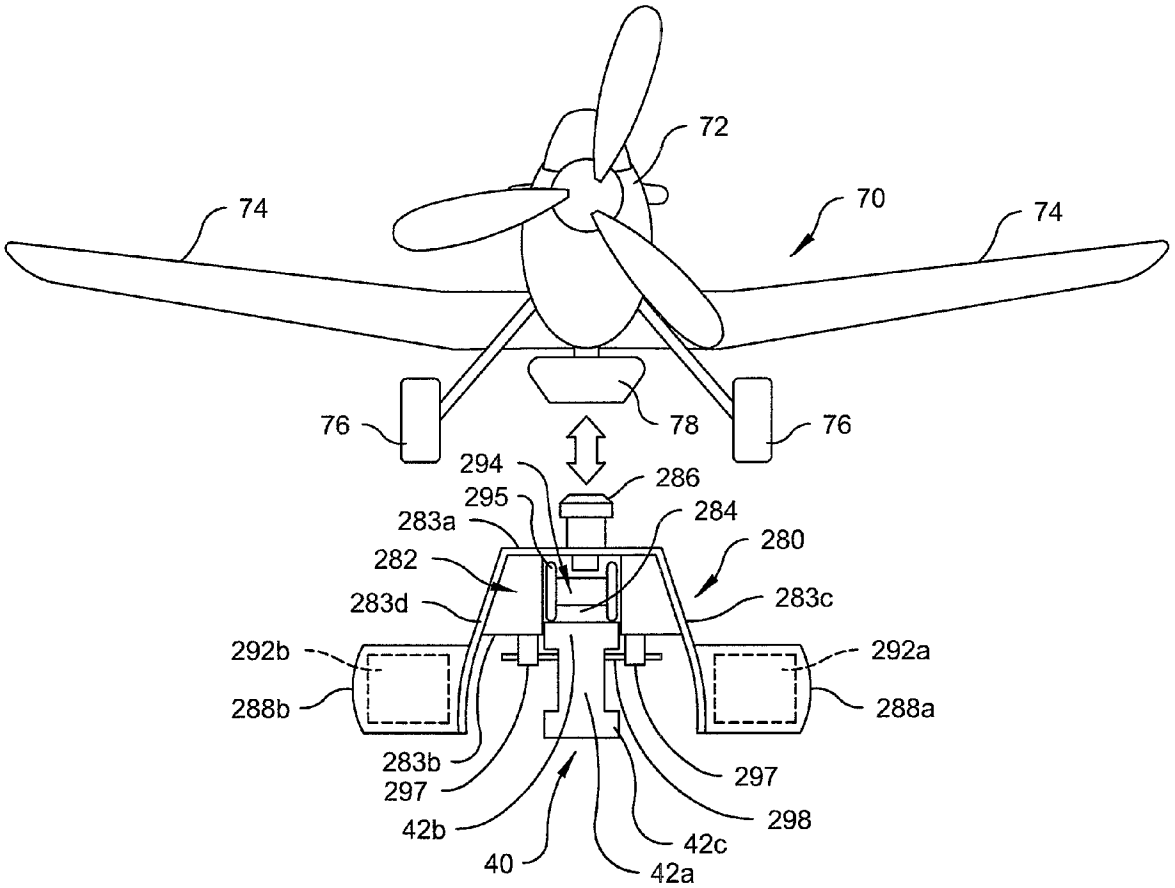
FIG. 5 is a front view of a toy plane releasably mountable to a second embodiment carrier.
Figure 7:
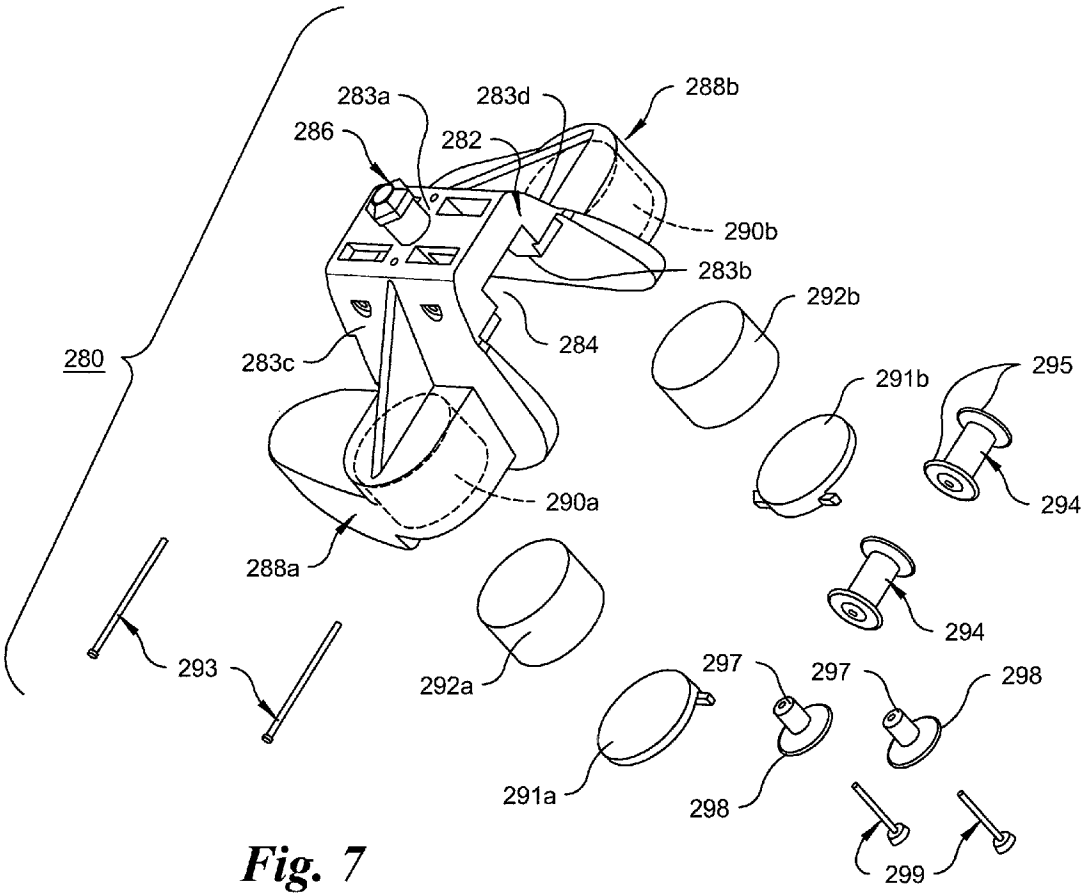
FIG. 7 is an exploded view of the second embodiment carrier of FIGS. 5 and 6.

FIGS. 5-7 depict a second embodiment carrier indicated at 280 in those figures. Again, a vehicle connector structure/mushroom-headed stalk 286 extends away from an upper surface/side 283*a* of the main housing 282. A through channel 284 is provided on a lower or bottom side 283*b* of the main housing 282 opposite the connector 286. Through channel 284 is preferably a generally inverted, U-shaped configuration is formed by the lower/bottom side 283*b* of the main housing 282. Again, opposing, spaced apart, preferably mirror image legs 288*a*, 288*b* extend downwardly and away from the lower/bottom side 283*b* of the main housing 282 and through channel 284 on opposite lateral sides 283*c*, 283*d* of the main body 282 and the through channel 284. The legs 288*a*, 288*b* again contain internal weight members 292*a*, 292*b* (FIG. 7) in hollow cavities or chambers 290*a*, 290*b* (in phantom) respectively, and may be retained by covers 291*a*, 291*b*, respectively. Again, at least one and preferably a pair of rollers 294, more preferably in the form of spools, are located sequentially along an uppermost, inner side of the through channel 284 (closest to the vehicle connector structure 278), and are supported for rotation on transverse horizontal axes provided by axles 293. Furthermore, at least one and preferably as seen in FIGS. 5-7, a pair of rollers 297 and more preferably wheels in the form of half spools with a single radially outwardly extending flange 298, are provided side by side between and beneath the rollers/spools 294, adjoining separate ones of the legs 288*a*, 288*b*, for rotation about vertical axes provided by axles 299, that are oriented perpendicular to the axles 293 forming the rotational axes of the rollers/spools 294. As best seen in FIG. 5, the rollers/spools 294 are sized and positioned in the through channel 284 such that the rollers 294 ride on the running surface 43 of the transverse beam 42*b* of the monorail track 40 on the outer flanges 295 of the rollers/spools 294 while the single flanges 299 of the wheels/half spools 298 are spaced apart laterally to form a gap wide enough to receive the main beam 42*a* of the monorail track 40 but close enough to one another and far enough from the rollers/spools 294 to again capture the transverse beam 42*b* with running surface 43 on which the carrier 280 rides.

Referring to FIGS. 6 and 7, forward ends of the legs 288 are preferably "boat" shaped with bottom surfaces rising up and lateral surfaces tapering inwardly as the legs extend forwardly from the weight receiving chambers 290 at the rear ends of the legs so as to form prows with bottommost skid surfaces 289. The prows enable the carrier 280 with toy vehicle 70 to be guided on bottom and lateral surfaces of conventional, U-shaped track segments when and if provided. Other arrangements will occur to those of ordinary skill in the art.

The carriers 80, 280 may be mounted on beam 42*b* of monorail track 40 by being slipped onto one longitudinal end of the monorail track 40 where the end of the beam 42*b* is exposed like in FIG. 4. Alternatively, the width dimension of the beam 42*b* might be reduced at some point along the track 40 to form a neck like 48 in FIG. 6 to permit the fingers 97 or half spools 297 to be slipped past the transverse beam 42*b* and onto the main beam 42*a*.

Capturing the monorail track 40 with the carrier 80, 280 secured with the toy vehicle 70 permits the performance of stunts that could not be performed with conventional toy vehicle track sets. A helical section of monorail track like 44*a* can be provided which would cause the carrier 80, 280 and vehicle 70 to perform an outside spiral (barrel roll around the outside of the track) along the length of the helical section, with the toy vehicle 70 cantilevered through the carrier 80, 280 from the track 40. Referring to FIG. 1, at least a portion of either or both monorail tracks 40*a*, 40*b* between the starting gate 18 and intermediate support 50 is given a helical twist of at least one complete rotation and suggestedly plural complete rotations along at least part of their length between 18 and 50 to spiral or "roll" the carriers 80, 280 and their toy vehicles 70 around those portions of the tracks 40*a*, 40*b*, as is indicated by the corkscrew arrow representations 46*a*, 46*b* as they race side by side along those portions of the tracks 40*a*, 40*b*.

Intermediate track supports may be provided in a variety of forms. Intermediate support 50 is stationarily positioned on a support surface 14 and preferably connected by beam 52 with the finish gate 60 to keep the support upright and stationary with respect to the finish gate. Brackets 54*a*, 54*b* further permit individual track sections 44*a*, 44*b* to be joined. In addition, free floating supports 56 can be provided. Supports 56 have a center beam 56*a* with a pair of clamps 56*b* at opposite longitudinal ends of the center beam 56*a*. The claims may be U shaped and sized to frictionally engage a transverse beam 42*c* of either track 40 across its width or just an end of such beam overhanging the central beam 42*a* of the track 40. Again, other arrangements will occur to those of ordinary skill.

Figure 8:
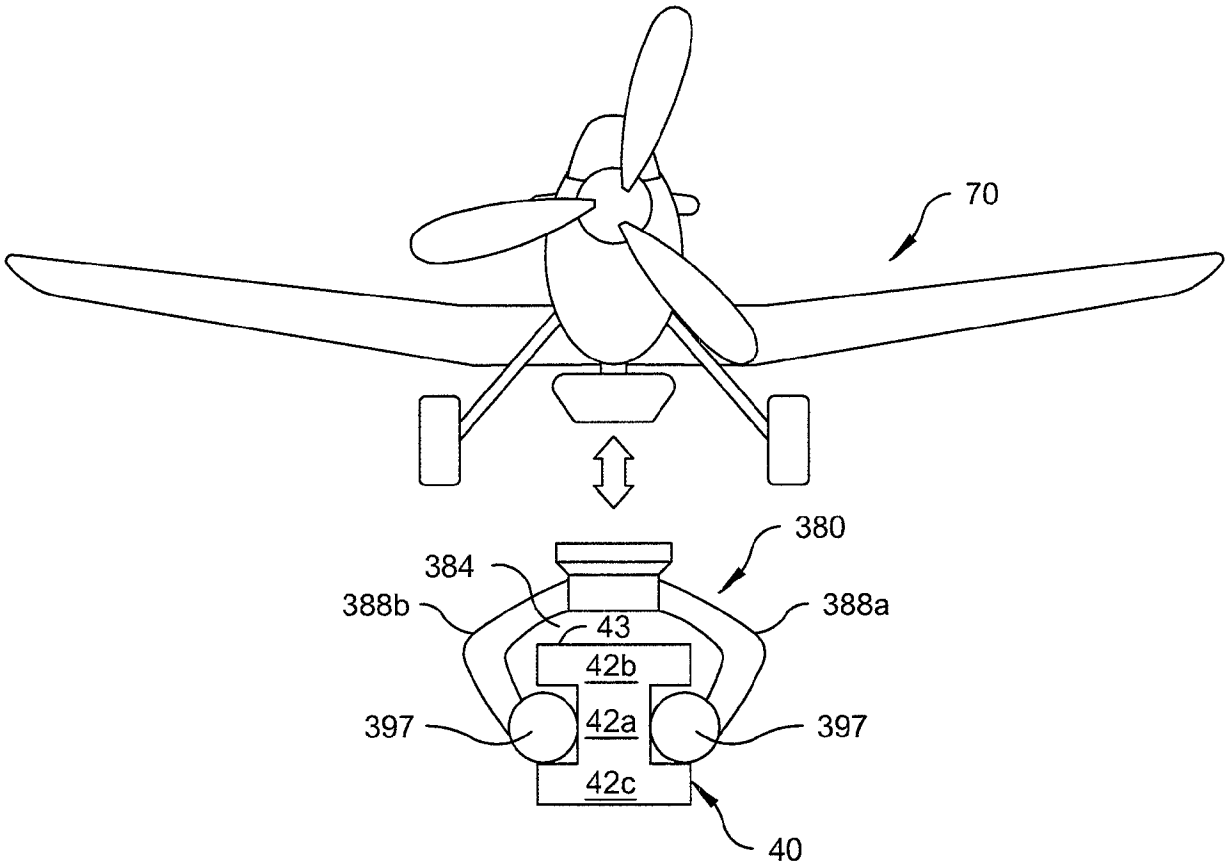
FIG. 8 is a front view of a toy plane releasably mountable to a third embodiment carrier.

FIG. 8 indicates a third embodiment carrier 380 in which the legs 388*a*, 388*b* are generally < > shaped with enlarged spherical tips 397 to define a through channel 384 and that ride below a transverse beam 42*b* and along the sides of the central beam 42*a* of the monorail track 40 to capture the running surface portion 43 of the track 40.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention.

What we claim is:

1. A carrier configured for removable attachment to a toy vehicle to connect the toy vehicle with and to support the toy vehicle to move along a running surface of an elongated monorail track, the carrier comprising:

a main housing having a lower side with a through channel configured to receive at least the running surface portion of the monorail track, wherein the through channel has a generally inverted U shaped configuration;

a pair of legs extending downward and away from the main housing and the through channel on opposite sides of the main housing and the through channel;

a plurality of rollers supported in the generally inverted U shaped channel so as to face the running surface of the monorail track received in the generally inverted U shaped through channel wherein each of the rollers is a spool having a pair of axially spaced, radially extending outer flanges, the outer flanges being sufficiently close to one another to support the carrier on the running surface of the monorail track received in the through channel; and at least one toy connector structure on an upper side of the main housing opposite the lower side, the connector structure being configured for removable attachment of the carrier to the toy vehicle.

2. The carrier of claim 1 wherein the monorail track includes a central beam supporting a transverse beam, the transverse beam forming the running surface of the monorail track, the carrier further comprising a pair of members extending from opposing inner facing sides of the through channel towards one another sufficiently to capture the transverse beam between the pair of members and the pair of rollers.

3. The carrier of claim 2 wherein each of the opposing members is a finger fixedly extending from an inner side of the main housing defining one of a pair of sides of the generally inverted U shaped through channel.

4. The carrier of claim 2 wherein each of the pair of members is a wheel supported to roll along a facing surface of the central beam of the monorail track received in the through channel.

5. The carrier of claim 1 wherein the toy connector structure is a single mushroom-headed stalk extending away from the main housing.

6. The carrier of claim 5 in combination with the toy vehicle, the toy vehicle having a recess configured to releasably receive the single mushroom-headed stalk of the carrier.

7. The carrier of claim 1 in combination with the toy vehicle wherein the toy vehicle has a carrier connector structure on a bottom side configured for releasable engagement with the toy connector structure of the carrier.

8. The carrier and toy vehicle combination of claim 7 wherein the carrier connector structure is a generally hexagonal recess.

9. The carrier of claim 1 in combination with the toy vehicle and the monorail track in a play set.

10. The carrier, toy vehicle and monorail track combination play set of claim 9, wherein the monorail track has a helical twist of at least one complete rotation along at least part of the track.

11. The carrier of claim 2 in combination with the toy vehicle and the monorail track in a play set, wherein a transverse, width dimension of the transverse beam is reduced at some point along the track to form a neck to permit the pair of members to be slipped past the transverse beam and onto the central beam.

12. The carrier, toy vehicle and monorail track combination of claim 11 wherein the neck is located at a beginning end of the monorail track and further comprising launcher having a base supporting a rail bracket receiving the beginning end of the monorail track and a housing, the housing supporting a plunger proximal the beginning end and a manual actuator operably connected with the plunger to advance the plunger upon movement of the actuator to propel the toy vehicle coupled with the carrier on the beginning end of the track from the beginning end to an opposing terminal end of the track.

13. The carrier, toy vehicle and monorail track combination of claim 12 further comprising a finish gate supporting the terminal end of the monorail track.

14. The carrier of claim 1 in combination with elongated monorail track and the toy vehicle, the carrier being removably attachable to the toy vehicle and configured to secure the toy vehicle to the monorail track so as to support the toy vehicle to run along the monorail track, the carrier being the only connection between the toy vehicle and the monorail track and the through channel being configured to capture at least a portion of the track.

15. The toy vehicle race set of claim 14 further comprising a launcher having a base supporting a rail bracket receiving a beginning end of the monorail track, a plunger proximal the beginning end and a manual actuator operably connected with the plunger to advance the plunger upon movement of the actuator to propel the toy vehicle coupled with the carrier on the beginning end of the monorail track from the beginning end to an opposing terminal end of the track.

16. The carrier of claim 1 further comprising at least a first weight member supported from the main housing by one of the pair of legs at a position below the main housing and the through channel and the running surface of the monorail track in the through channel.

17. The carrier of claim 16 further comprising at least a second weight member supported from the main housing by a remaining one of the pair of legs at a position below the main housing and the through channel and the running surface of the monorail track in the through channel.

18. A carrier configured for removable attachment to a toy vehicle to connect the toy vehicle with and to support the toy vehicle to move along a running surface of an elongated monorail track, the carrier comprising:

a main housing having a lower side with a through channel configured to receive at least the running surface portion of the monorail track, wherein the through channel has a generally inverted U shaped configuration;

a pair of legs extending downward and away from the main housing and the through channel on opposite sides of the main housing and the through channel;

at least one toy connector structure on an upper side of the main housing opposite the lower side, the connector structure being configured for removable attachment of the carrier to the toy vehicle;

a first weight member supported from the main housing below the main housing and the through channel and the running surface of the monorail track in the through channel;

a second weight member, the first and second weight members being supported by separate legs of the pair below the running surface of the monorail track received in the through channel; and wherein the pair of legs are mirror images of one another, each with a chamber at a rear end receiving the weight member supported by that leg and a forward end.

19. The carrier of claim 18 wherein each forward end of the each leg defines a prow with bottommost skid surface.

20. The carrier of claim 18 wherein the forward end of each of the pair of legs is boat shaped with a bottom surface of each leg rising up and lateral surfaces tapering inwardly as the forward end extends forwardly from the weight receiving chamber at the rear end of the leg.

* * * * *